United States Patent [19]

Sanders

[11] Patent Number: 4,920,654

[45] Date of Patent: May 1, 1990

[54] VIEWING APPARATUS

[76] Inventor: Ronald J. Sanders, P.O. Box 658, Floodwood, Minn. 55736

[21] Appl. No.: 176,617

[22] Filed: Apr. 1, 1988

[51] Int. Cl.[5] ..... F41G 1/16

[52] U.S. Cl. ..... 33/252; 33/257; 33/259; 42/100

[58] Field of Search ..... 33/252, 253, 254, 257, 33/258, 259, 260, 245, 247, 248, 265; 42/100, 101, 102; 248/291, 289.1

[56] References Cited

U.S. PATENT DOCUMENTS

| | | | |
|---|---|---|---|
| 374,202 | 12/1887 | Rice | 33/247 |
| 523,887 | 7/1894 | Favre | 33/254 |
| 830,052 | 9/1906 | Chadwick | 33/254 |
| 1,273,019 | 7/1918 | Wiggins | 33/258 |
| 2,334,300 | 11/1943 | Williams | 33/253 |
| 2,335,881 | 12/1943 | Persinger | 33/260 |
| 2,445,595 | 7/1948 | Bengert | 33/247 |
| 2,446,970 | 8/1948 | Wilson | 33/260 |
| 2,458,510 | 1/1949 | Garand et al. | 33/260 |
| 2,669,023 | 2/1954 | Pizzuti | 33/265 |
| 2,719,739 | 10/1955 | Copeland | 248/291 |
| 3,026,618 | 3/1962 | Vardara | 33/259 |
| 3,908,950 | 9/1975 | Apel | 33/254 |
| 4,734,989 | 4/1988 | Sanders | 33/254 |

*Primary Examiner*—Thomas B. Will

*Assistant Examiner*—Patrick R. Scanlon

*Attorney, Agent, or Firm*—Peterson, Wicks, Nemer & Kamrath

[57] ABSTRACT

Preferred forms of viewing apparatus according to the teachings of the present invention are shown as including an enclosed and elongated see-through passage having a hooded front opening. The rear end of the enclosed and elongated see-through passage includes a visually opaque annular perimeter portion extending around a rear opening of a size smaller than the front opening. The effect of the passage, the size relationships of the front and rear openings, and the annular perimeter portion is to separate the targeted object from its immediate surroundings and to create a visual window effect rather than a tunnel effect. In its most preferred form, the passage has a constant size throughout its length and the annular perimeter portion extends radially into the passage. The viewing apparatus includes a camouflage cover which can be removably secured thereto and a range finder on the annular perimeter portion for judging distances to the targeted object. In preferred forms of the viewing apparatus including sighting members within the passage according to the teachings of the present invention, apparatus for providing windage and elevation adjustment is incorporated with the enclosed and elongated see-through passage.

12 Claims, 3 Drawing Sheets

32
76
74
24
76
74
76
74
76
10
108
22
72
60
28
106
14
100
98
64
70
62
108
102
104
106
100
70
21
58
66
56
112
102
16
104
110
110
18
20
56
30
98
88
96
112
92
96
86
94
86
50
88
50
50
84
90
90
54
26

116
58
120
21
130
52
128
114
126
118
82
132
124
40
42
122
36

VIEWING APPARATUS

CROSS REFERENCE

This is a divisional of co-pending application Ser. No. 06/917,799 filed on Oct. 9, 1986, now U.S. Pat. No. 4,734,989 which is a continuation-in-part of U.S. Ser. No. 855,959 filed on Apr. 25, 1986, now U.S. Pat. No. 4,734,990.

BACKGROUND

The present invention generally relates to viewing apparatus, more particularly in a preferred form, to viewing apparatus for weaponry, and in most preferred forms to viewing apparatus for sight aiming weaponry.

Weaponry such as rifles, shotguns, handguns, and bows is currently affixed with one type of open sighting or another and is quite often affixed with special optical lenses, scopes, etc., which in effect are designed to aid viewing by magnification of a particular viewed object for the purpose of better aiming and placement of a discharged projectile from said weaponry. Although in many instances magnification is the preferred method of sighting distant targets, it is in many instances used in situations where over or under focusing can cause magnification too extreme or insufficient for many types of weaponry usage such as woodland, swamp and brush hunting or just a short yardage situation in which open sights would present a more acceptable view. Another downfall of using optical lenses for magnification of a viewed object is condensation which can develop in extreme cold or inclement weather within the enclosed tubular structure. Further, with said open sights now furnished on weaponry, it is necessary to have good lighting at the time of aim or a lighted background to the viewing area so that the currently used open sights can be aligned properly. Also, distant shots are more difficult to execute with accuracy and the blotting out of part of the target at even acceptable distances makes for unprecise shooting.

This invention relates then to the incorporation of the advantages of the two most widely used means of aiming a weapon. It is further designed to eliminate the downfalls of both open sight aiming and optical lens magnification aiming and at the same time incorporate more important factors not found in either aforementioned methods of aiming at a viewed object, such as quickly establishing a target area at close range because of the separation of the desired target area from its surroundings. The invention is also unaffected by weather conditions and can improve aiming capability in darkened conditions. It is also an acid in identifying the distance of a viewed object.

SUMMARY

The present invention solves these and other needs and problems in viewing apparatus for weaponry for viewing of a targeted object by a viewer by providing, in the most preferred form, an enclosed and elongated see-through passage. A front opening is formed in the front end of the enclosed and elongated see-through passage. An annular perimeter portion extending around a rear opening is formed in the rear end of the enclosed and elongated see-through passage. The annular perimeter member and the rear opening therein have a size generally equal to the size of the front opening, with the size of the rear opening being smaller than the front opening preventing a halo or tunnel effect created by the enclosed and elongated see-through passage when the targeted object is viewed through the enclosed and elongated see-through passage. The annular perimeter member is visually opaque for limiting the viewer's peripheral vision to the rear opening and the enclosed and elongated see-through passage. The length of the enclosed and elongated see-through passage allows the eye of the viewer to be focused from the rear opening through the front opening on the targeted object and to shadow the rear opening from any light entering the front opening.

In another preferred aspect of the present invention, a device for adjustably securing a sighting apparatus to weaponry at one of a plurality of angles about an axis generally perpendicular to the viewer's sighting direction along the sighting apparatus is provided including a generally U-shaped pivotal mounting member secured to the weaponry. The pivotal mounting member has first and second arms upstanding from a central portion. The sighting apparatus is pivotally mounted to the pivotal mounting member by a semi-circular member secured to the sighting apparatus and pivotally mounted between the first and second arms of the pivotal mounting member. An arcuate member is arranged concentrically with the semi-circular member to define an arcuate slot therebetween. A bolt extends through the first arm and the arcuate slot and is threadably received in the second arm for sandwiching the semi-circular member and the arcuate member between the first and second arms of the pivotal mounting member.

In still another preferred aspect of the present invention, a device for providing elevation adjustment of a sighting apparatus with respect to weaponry is provided where the sighting apparatus is adjustably secured to the weaponry at one of a plurality of positions with respect to the weaponry between an upper position and a lower position, with the sighting apparatus being parallel in each of the plurality of positions to the upper and lower positions. Specifically, the device includes a member secured to the weaponry for slidably receiving the sighting apparatus having elongated slots formed therein for receiving elongated protuberances formed on opposite sides of the sighting apparatus. The sighting apparatus is removably fixed in the slidably receiving member.

It is thus an object of the present invention to provide a novel viewing apparatus.

It is further an object of the present invention to provide such a novel viewing apparatus for attachment to weaponry such as rifles.

It is further an object of the present invention to provide such a novel viewing apparatus which is simple to mount.

It is further an object of the present invention to provide such a novel viewing apparatus which is simple to adjust for elevation.

It is further an object of the present invention to provide such a novel viewing apparatus which is simple to adjust for windage.

It is further an object of the present invention to provide such a novel viewing apparatus specifically designed for brush and deep wood hunts.

It is further an object of the present invention to provide such a novel viewing apparatus having superior sighting accuracy.

It is further an object of the present invention to provide such a novel viewing apparatus which is formed of durable, unbreakable parts.

It is further an object of the present invention to provide such a novel viewing apparatus which solves common sighting judgment problems.

It is further an object of the present invention to provide such a novel viewing apparatus allowing precise and effective sighting.

It is further an object of the present invention to provide such a novel viewing apparatus which improves sight picture and shooting vision.

It is further an object of the present invention to provide such a novel viewing apparatus which may be utilized in any type of weather.

It is further an object of the present invention to provide such a novel viewing apparatus which may be utilized in all light conditions.

It is further an object of the present invention to provide such a novel viewing apparatus which does not include lenses or transparent discs.

It is further an object of the present invention to provide such a novel viewing apparatus having no magnification.

It is further an object of the present invention to provide such a novel viewing apparatus having no fogging or moisture beading problems.

It is further an object of the present invention to provide such a novel viewing apparatus which incorporates the advantages of the two most widely used means of aiming a weapon.

It is further an object of the present invention to provide such a novel viewing apparatus which separates the desired target area from its surroundings.

It is further an object of the present invention to provide such a novel viewing apparatus allowing better focal concentration.

It is further an object of the present invention to provide such a novel viewing apparatus which aids in identifying the distance of the targeted object.

It is further an object of the present invention to provide such a novel viewing apparatus which is inexpensive.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
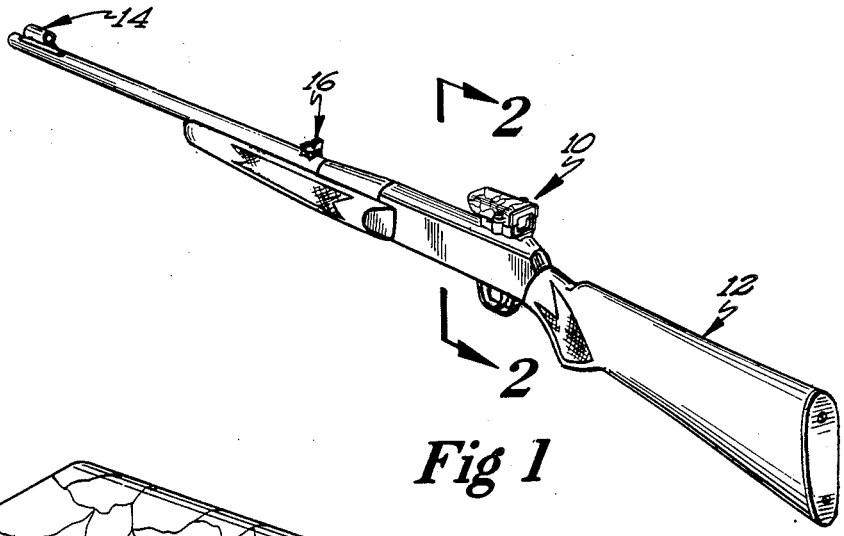
FIG. 1 shows a perspective view of a preferred form of a viewing apparatus mounted to a rifle according to the teachings of the present invention.

All figures are drawn for ease of explanation of the basic teachings of the present invention only; the extensions of the Figures with respect to number, position, relationship, and dimensions of the parts to form preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "upper", "lower", "first", "second", "front", "rear", "end", "edge", "longitudinal", "lateral", "inside", "outside", and similar terms are used herein, it should be understood that these terms have reference only to the structure shown in the drawings as it would appear to a person viewing the drawings and are utilized only to facilitate describing the invention.

DESCRIPTION

Viewing apparatus according to the teachings of the present invention are shown in the drawings and generally designated 10. Apparatus 10 are shown in its most preferred forms for attachment to weaponry such as a rifle 12 having a front sight 14 and a rear sight 16. Generally, apparatus 10 includes an enclosed and elongated see through passage 18 having a rear end having opening 20 and a front end having opening 22. Apparatus 10 further includes a hood 24 extending beyond front opening 22 in an awning-like manner. Passage 18 has a length sufficient to direct the focus of the eye of the viewer on the targeted object and to shadow rear opening 20 from any light entering front opening 22. In its most preferred form, passage 18 has a minimum length of 1¼ inch (3.175 cm). Hood 24 prevents light from entering front opening 22 when the sun is directly overhead and possibly reflecting within the interior of passage 18. Thus, passage 18 and hood 24 allow a limited amount of indirected tunnelled light to enter a limited viewing area while restricting direct light and glare coming off sights 14 and 16.

According to the teachings of the present invention, rear opening 20 has a smaller size than front opening 22 such that a halo or tunnel effect is not created when a targeted object is viewed through passage 18 from rear opening 20 through front opening 22 when rear opening 20 is approximately 18 inches (46 cm) from the user's eye. In its most preferred form, rear opening 20 is reduced ⅛ inch (0.32 cm) in size from the size of front opening 22 for the first inch (2.54 cm) of the length of passage 18, is reduced 1/16 inch (0.16 cm) for the second inch (2.54 cm) of the length of passage 18, is reduced 1/32 inch (0.08 cm) for the third inch (2.54 cm) of the length of passage 18, is reduced 1/64 inch (0.04 cm) for the fourth inch (2.54 cm) of the length of passage 18, and is reduced in like manner for the total length of passage 18. In its most preferred form, rear opening 20 has an area no more than one square inch (6.45 $cm^2$) in relationship to an area not less than 1.27 square inches (8.16 $cm^2$) of front opening 22 per one inch (2.54 cm) of length of passage 18.

Further according to the teachings of the present invention, rear opening 20 is located within an annular perimeter portion 21 surrounding opening 20 and having a width substantially greater than the thickness of the walls forming and defining passage 18. In the preferred form, annular perimeter portion 21 and opening 20 include the same area as front opening 22 and in the most preferred form, passage 18 has a constant diameter and size throughout its length as front opening 22. Rear opening 20 is located centrally from the sides of passage 18 but is located slightly lower than a central position from top to bottom of passage 18 such that the walls forming hood 24 are not seen by the viewer. It can then be seen that utilizing hood 24 according to the teachings of the present invention rather than an extended passage maximizes the size of rear opening 20 in comparison to the size of front opening 22. In the most preferred form, annular perimeter portion 21 is formed by and rear opening 20 is defined by members extending radially inwardly of passage 18. It can then be realized that passage 18 of a constant diameter and the generally central location of rear opening 20 eliminate tunnel vision from a viewer seeing the side walls defining passage 18 at the same time as seeing the forward view as would occur with conical shaped passages and create a window rather than a tunnel effect to a concentrated target area.

Furthermore, due to the opaque nature of annular perimeter portion 21, the targeted object appears to be illuminated when viewed through passage 18 according to the teachings of the present invention. Specifically, in a manner that light appears to a viewer to have greater illumination when it passes through a pinhole, the light passing through rear opening 20 from passage 18 and within annular portion 21 and thus the targeted object as viewed by the viewer through passage 18 appears to be illuminated from its surrounding environment when utilizing viewing apparatus 10 according to the teachings of the present invention.

It can then be appreciated that viewing apparatus 10 according to the teachings of the present invention tunnels the viewer's total focal concentration on the targeted object by separating the targeted object from its surroundings and by limiting the distractions to the viewer. Specifically, when sighting in rifle 12, viewing apparatus 10 according to the teachings of the present invention and in particular, annular perimeter portion 21 forces the user's view through passage 18 since the user's vision will be directed towards the visually open passage 18 by the visually closed or opaque annular perimeter portion 21 limiting the viewer's peripheral vision to that which can be seen inside annular perimeter portion 21 and through passage 18. Furthermore, due to the relationship of openings 20 and 22, the viewer's peripheral vision will be limited such that the walls defining passage 18 will not be seen but rather the viewer's focal concentration will be through passage 18. Additionally, the relationship of openings 20 and 22 allows the quick and precise orientation and aiming of rifle 12 towards the targeted object since the viewer can quickly move rifle 12 until the walls defining passage 18 will not be seen.

In a first preferred form shown in FIGS. 1–4, viewing apparatus 10 is utilized with front and rear sights 14 and 16 in place on rifle 12 and generally includes a base portion 26, a top portion 28, a range finder card 30, and a cover 32. Base portion 26 has a generally U-shaped cross section and specifically includes a generally V-shaped base 34 having a central portion 36 and two flat walls 38 extending angularly on opposite sides of central portion 36. Portion 36 has an outer surface having a shape complementary to and for receipt on rifle 12 and includes a first circular aperture 40 and a second elongated aperture 42 for receipt of screws 44 for mounting viewing apparatus 10 to rifle 12. Base portion 26 further includes first and second flat walls 46 extending on opposite sides of V-shaped base 34. Walls 46 include longitudinally extending mounting elements 48 contiguous with their free edges and further include lateral threaded mounting shoulders 50 extending downwardly and slightly spaced from their free edges. Base portion 26 further includes a generally U-shaped member 52 adjacent its rear end and received between base 34 and walls 46 defining the bottom 54 and sides 56 of rear opening 20 of passage 18. Base portion 26 further includes first and second concentric ridges 58 formed on member 52 and located around opening 20 and along the outside edges of walls 46.

Top portion 28 is generally U-shaped and includes a generally flat top 60 having downwardly extending walls 62 on opposite sides thereof. The spacing between the inside surfaces of walls 62 is generally equal to the spacing between the outside surfaces of walls 46 such that walls 62 of top portion 28 are slidably received on walls 46 of base portion 26. Top portion 28 includes a generally U-shaped member 64 adjacent its rear end received between top 60 and walls 62 defining top 66 of rear opening 20 of passage 18. First and second concentric ridges 58 are formed on member 64 and located around opening 20 and along the outside edges of top portion 28. Mounting projections 68 are formed on walls 62 extending down from top 60 of top portion 28 and are located intermediate the front and rear ends of top portion 28. Mounting elements 48 of base portion 26 are captured between mounting projections 68 and member 64 when top portion 28 is slidably received on base portion 26 to prevent longitudinal movement of top portion 28 relative to base portion 26. Mounting ears 70 extending horizontally from the free edges of walls 62 are provided for receiving screws 72 for threadable receipt in shoulders 50 of base portion 26 for securing top portion 28 to base portion 26. It should then be noted that passage 18 of viewing apparatus 10 is formed by base 34, walls 46, top 60 and walls 62, with front opening 22 formed by the front ends of base 34 and walls 46 and top 60 and walls 62 adjacent to projections 68. Hood 24 is formed by top 60 and walls 62 extending beyond projections 68 and front opening 22. Perimeter portion 21 around rear opening 20 is formed by members 52 and 64.

Cover 32 in its most preferred form is vinyl covered metal having a size and shape complementary to and for receipt on top portion 28. Cover 32 includes slots 74 in its downwardly extending walls for receipt around ears 70 and mounting shoulders 50. To secure cover 32 to top portion 28, cover 32 includes snap edges 76 for removable abutment with the free edges of walls 62 of top portion 28. In its most preferred form, the vinyl of cover 32 includes a camouflage pattern.

It can then be appreciated that elevation and windage adjustments may be made to front and rear sights 14 and 16 of rifle 12 utilizing viewing apparatus 10 according to the preferred teachings of the embodiment of FIGS.

1–4 of the present invention in the customary manner. Viewing apparatus 10 according to the teachings of the present invention when preferably mounted to the rear pair of scope mount sets of rifle 12 provides a window effect to the viewer's total focal concentration with the targeted area and sights 14 and 16 are utilized to aim rifle 12 at the particular targeted object.

Judging distance isn't always easy. Even for the most skilled marksman or archer, distance can sometimes play tricks that cause the miss of a trophy kill. By predetermining distances from a known source, a nearly precise calculation can be achieved by knowing the natural heights and lengths of distant objects in relationship to a known point of view. Taking advantage that the viewer's eye will wander and can observe more than one object at a time by increasing the viewing distance, viewing apparatus 10 includes range finder card 30 located on perimeter portion 21 around rear opening 20 according to the teachings of the present invention. In its most preferred form, range finder card 30 has a size and shape complementary to and for receipt between ridges 58 of the rear end of viewing apparatus 10, on annular perimeter 21, and around rear opening 20. In its most preferred form, card 30 is secured to annular perimeter portion 21 such as by adhesive. In the embodiment shown in FIGS. 1–4, card 30 is in two pieces corresponding to members 52 and 54.

Figure 5:
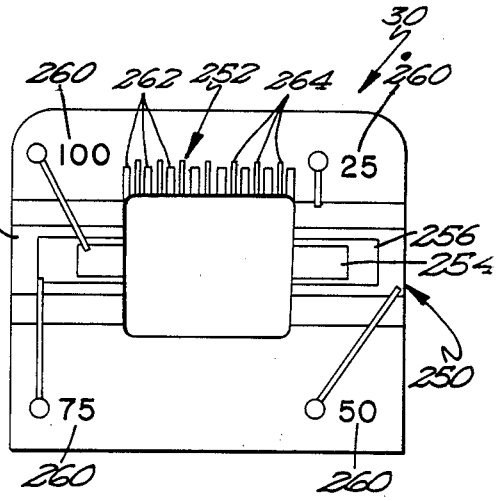
FIG. 5 shows an enlarged view of a range finder card for use with viewing apparatus according to the teachings of the present invention.

As best seen in FIG. 5, range finder card 30 includes various calibrated distances according to the height of the targeted object and various calibrated distances according to the length of the targeted object printed, engraved, etched or otherwise marked on card 30. In particular and in its most preferred form, range finder card 30 includes a first range finder portion 250 for determining the distance of the targeted object by its height and a second range finder portion 252 for determining the distance of the targeted object by its length.

In its most preferred form, first portion 250 includes rectangular member 254 extending from sides 56 of opening 20 and centrally between top 66 and bottom 54 of opening 20. The height along side 56 of rectangular members 254 is chosen such that the average height of the target area such as the chest cavity of a deer or other animal to be hunted extends the height of rectangular member 254 at a set distance, for example one hundred yards or meters. First portion 250 in its preferred form includes a first U-shaped member 256 having the free ends of its legs terminating in sides 56 of opening 20 and encircling rectangular member 254. The height along side 56 of member 256 is chosen such that the average height of the target area such as the chest cavity of a deer or other animal to be hunted extends the height of member 256 at a set distance, for example, seventy-five yards or meters. First portion 250 in its preferred form includes a second U-shaped member 258 having the free ends of its legs terminating in sides 56 of opening 20 and encircling rectangular member 254 and U-shaped member 256. The height along side 56 of member 258 is chosen such that the average height of the target area such as the chest cavity of a deer or other animal to be hunted extends the height of member 258 at a set distance, for example, 50 yards or meters. The height along side 56 of opening 20 is chosen such that the average height of the target area such as the chest cavity of a deer or other animal to be hunted extends the height of opening 20 at a set distance, for example 25 yards or meters. In its most preferred form, range finder card 30 includes suitable members 260 such as indicia for identifying the various calibrated distances of first portion 250.

In its most preferred form, second portion 252 includes graduated lines extending from and along top 66 of opening 20 and in its most preferred form includes alternating, spaced, first and second line types 262 and 264, with the first line type 262 having a width along top 66 and a height extending from top 66 and the second line type 264 having a width along top 66 less than the width of type 262 and having a height extending from top 66 greater than the height of type 262. The spacing between line types 262 and 264 is chosen so that the length of the target area such as the body of a deer or other animal extends along portion 252 a set distance.

Figure 6:
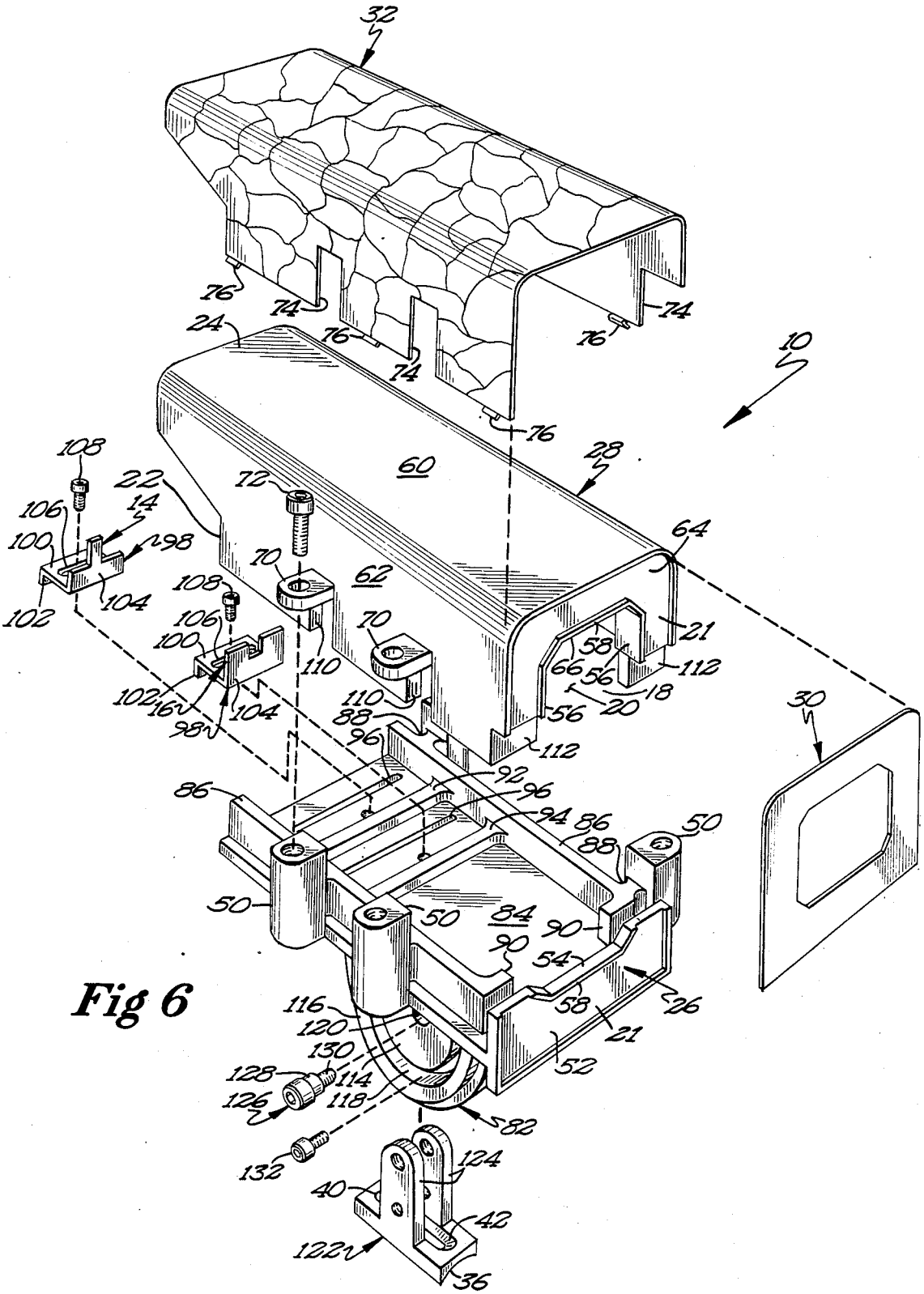
FIG. 6 shows an exploded, perspective view of a preferred form of a viewing apparatus according to the teachings of the present invention.

In another preferred form shown in FIG. 6, front and rear sights 14 and 16 are located within passage 18 of viewing apparatus 10 and viewing apparatus 10 generally includes an elevation adjustment portion 82, a base portion 26, a top portion 28, a range finder card 30, and a cover 32. Base portion 26 includes a generally flat base plate 84 having a top surface and a bottom surface. First and second walls 86 are provided extending upwardly from the top surface of base plate 84 generally parallel to but spaced from the side edges of base plate 84 from the front end of base plate 84 to a point spaced from the rear end of base plate 84. Lateral threaded mounting shoulders 50 are provided in the preferred form extending upwardly from the side edges of base plate 84. Shoulders 50 are further secured to walls 86 by connectors 88 which are integrally formed with shoulders 50 and walls 86. Base portion 26 further includes a generally U-shaped member 52 attached to the rear end of base plate 84. Base portion 26 further includes laterally extending mounting elements 90 extending upwardly from the top surface of base plate 84 generally parallel to but spaced from the rear end of base plate 84 and member 52 generally perpendicular and integral with walls 86.

For purposes of providing windage adjustment of front and rear sights 14 and 16, base plate 84 includes front and rear, parallel, spaced adjustment bosses 92 and 94 extending upwardly from the top surface of base plate 84 generally parallel to but spaced from the front end of base plate 84 and extending between and integral with walls 86. Further provided are elongated slots 96 formed in base plate 84 generally parallel to but spaced from the front end of base plate 84 and from bosses 92 and 94. Front and rear sights 14 and 16 in the preferred form are formed on Z-shaped members 98 having a first flat central portion 100 including a first leg 102 extending downwardly generally perpendicular thereto from one edge for slidable receipt in slots 96 and including a second leg 104 extending upwardly generally perpendicular to central portion 100 from its opposite edge for slidable abutment with bosses 92 and 94. Front and rear sights 14 and 16 are formed integral and as part of leg 104 of Z-shaped members 98. Elongated, lateral slots 106 are formed in central portion 100 for receipt of screws 108 threadably received in base plate 84. It can then be appreciated that slots 106 allow for side to side or lateral adjustment of front and/or rear sights 14 and 16 and screw 108 when tightened will hold front and rear sights 14 and 16 in position. Slots 96 and bosses 92 and 94 insure that front and rear sights 14 and 16 maintain the correct orientation in passage 18 and with respect to each other and assist screws 108 in holding front and rear sights 14 and 16 in position.

Walls 62 of top portion 28 include laterally extending slots 110 for receipt around connectors 88 of shoulders 50. The spacing between the inside surfaces of walls 62 is generally equal to the spacing between the outside surfaces of walls 86 such that walls 62 of top portion 28 are slidably received on walls 86 of base portion 26 between shoulders 50 and walls 86. Top portion 28 includes a generally U-shaped member 64 adjacent its rear end received between top 60 and walls 62, with the free ends of member 64 abutting with the free ends of member 52 of base portion 26. Mounting projections 112 are formed integrally with walls 62 and extending downwardly from the free ends of member 64 for slidable receipt between mounting elements 90 and member 52 of base portion 26.

Figure 4:
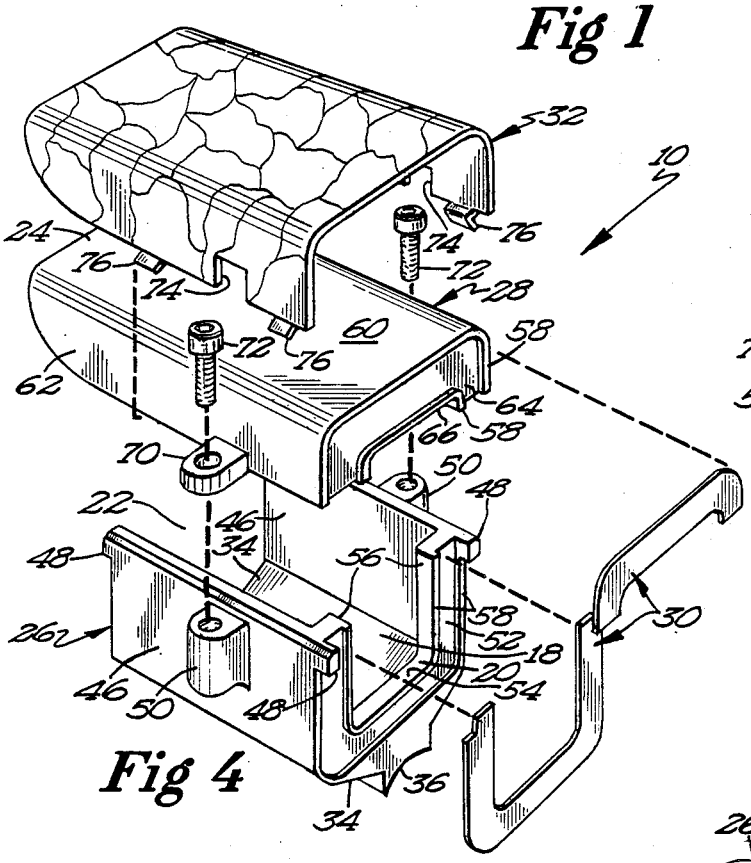
FIG. 4 shows an exploded, perspective view of the viewing apparatus of FIG. 1.
Figure 2:
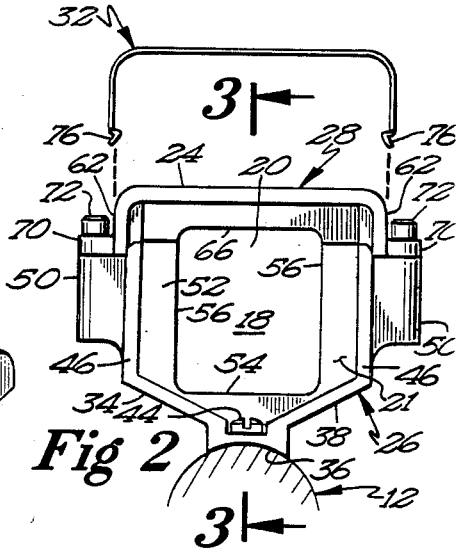
FIG. 2 shows an end view of the viewing apparatus of FIG. 1 according to view line 2—2 of FIG. 1.
Figure 3:
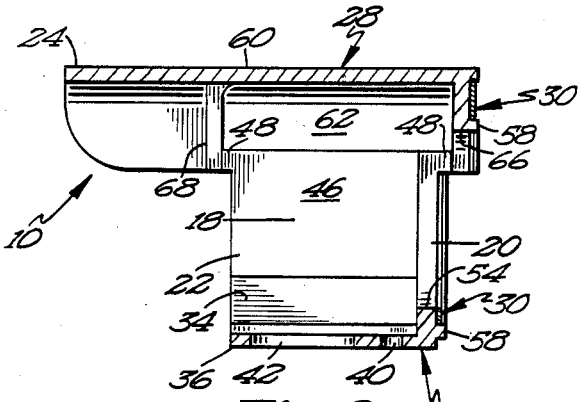
FIG. 3 shows a cross sectional view of the viewing apparatus of FIG. 1 according to section line 3—3 of FIG. 2.

Snap edges 76 of cover 32 in the embodiment of FIG. 4 are arranged to removably abut with the bottom surface of base plate 84.

In its most preferred form, elevation adjustment portion 82 includes a generally semi-circular member 114 and an arcuate member 116 arranged concentrically therewith to define an arcuate slot 118 therebetween. Members 114 and 116 extend downwardly from the bottom surface of base plate 84, with the base plate being parallel to the axis of members 114 and 116. An aperture 120 is provided extending through semi-circular member 114 along its axis.

Elevation adjustment portion 82 further includes pivotal mounting member 122 which is generally U-shaped and having first and second arms 124 upstanding from central portion 36 for receipt of members 114 and 116 therebetween. Semi-circular member 114 is pivotally mounted to member 122 by a shoulder screw 126 having a shoulder 128 extending through the first arm 124 and through aperture 120 of semi-circular member 114 and a threaded portion 130 threadably received in the second arm 124. It can then be appreciated that threaded portion 130 allows shoulder screw 126 to draw arms 124 together capturing semi-circular member 114 therebetween for removably fixing the angular positioning of semi-circular member 114 with respect to member 122. Further, in its most preferred form, screw 132 extends through first arm 124 and through slot 118 and is threadably received in first arm 124 for assisting screw 126 in removably fixing the angular positioning of semi-circular member 114 with respect to member 122 by sandwiching members 114 and 116 between arms 124. It can then be realized that shoulder 128 provides a smooth pivotal bearing surface for aperture 120 of member 122 to allow ease and accurate variations of the angular position of members 114 and 122 when screws 126 and 132 are not in a tightened relationship in arms 124.

To install and sight in viewing apparatus 10 according to the preferred form as shown in FIG. 6 and assuming that pivotal mounting member 122 has been secured to rifle 12 by screws 44 or suitable means preferably to the front pair of scope mount sets of rifle 12 and semi-circular member 114 has been secured to member 122, windage adjustments may be made by test firing rifle 12 and moving sights 14 and 16 by loosening screws 108 and sliding central portions 100 thereof on base plate 84. It can then be appreciated that legs 102 and slots 26 and leg 104 and bosses 92 and 94 insure that sights 14 and 16 maintain proper orientation during adjustment. When the windage adjustment has been accomplished, screws 108 may be securely tightened in base plate 84. It can be appreciated that it may be desirable to have top portion 28 removed from base portion 28 while windage adjustment is being accomplished.

Elevation adjustment may be made by test firing rifle 12 and pivoting base plate 84 about screw 126 to the desired elevation between shots. When the elevation adjustment is at the desired position, screws 126 and 132 may be securely tightened in member 122 to sandwich semi-circular member 114 and annular member 116 between arms 124 of pivotal mounting member 122. It can then be appreciated that front sight 14 may be filed down to match rear sight 16 after elevation adjustment has been completed such that the tops of sights 14 and 16 are aligned and sights 14 and 16 look like a block when sighting rifle 12 utilizing viewing apparatus 10 of the preferred form shown in FIG. 6 according to the teachings of the present invention.

Figures 7, 8:
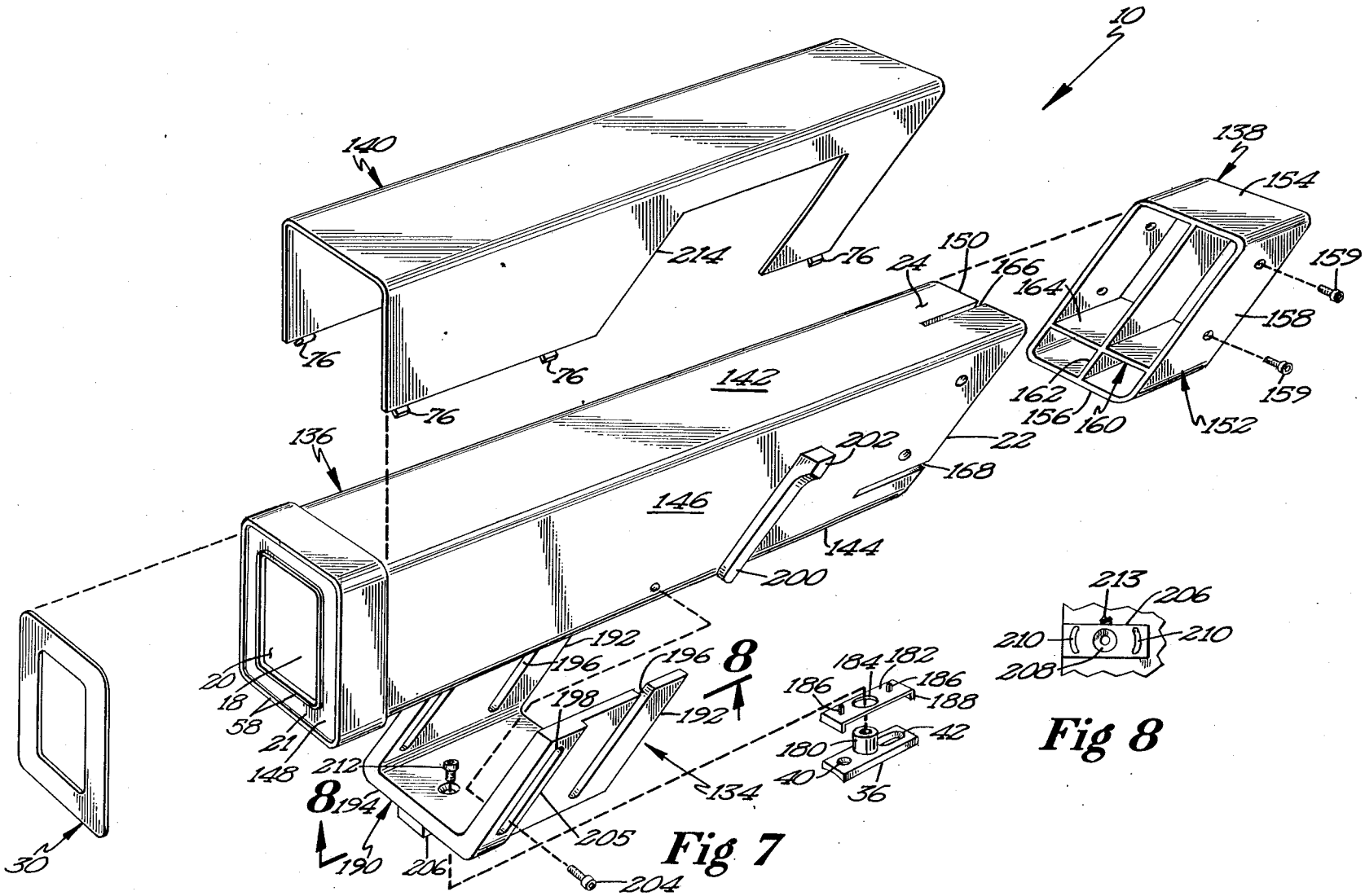
FIG. 7 shows an exploded, perspective view of a preferred form of a viewing apparatus according to the teachings of the present invention.
FIG. 8 shows a partial bottom view of the viewing apparatus of FIG. 7 according to view line 8—8 of FIG. 7.

In another preferred form shown in FIGS. 7 and 8, viewing apparatus 10 is utilized with front and rear sights 14 and 16 removed from rifle 12 and generally includes an elevation and windage adjustment portion 134, a tubular portion 136, a sight portion 138, a cover 140, and a range finder card 30. Tubular portion 136 generally includes a closed top 142, a closed bottom 144, first and second closed sides 146, and an integral end 148 including rear opening 20 and annular perimeter portion 21. Front opening 22 and hood 24 are defined by the opposite end of tubular portion 136, with top 142 extending beyond bottom 144 and sides 146 extending angularly between bottom 144 and top 142. Passage 18 is then formed and defined by top 142, bottom 144, and sides 146 of tubular portion 136.

Sight portion 138 is removably received on the end 150 of tubular portion 136 opposite end 148 and in its most preferred form includes a parallelepiped 152 having a rectangular top 154, a rectangular bottom 156, and parallelogram sides 158 and open ends. Sides 158 have an angular orientation generally equal to the orientation of the ends of sides 146 of tubular portion 136 between top 142 and bottom 144. The open ends of parallelepiped 152 have a size and shape for slidable receipt on end 150 of tubular portion 136 and may be removably secured thereon such as by screws 159 extending through parallelepiped 152 and threadably received in tubular portion 136. It can then be realized that the removable securement of sight portion 138 to tubular portion 136 allows its replacement by other types of sight portions 138 or in the event of damage thereto.

Sight portion 138 according for the teachings of the present invention includes a member 160 for sighting rifle 12 for the purpose of better aiming and placement of the discharged bullet from rifle 12. In its most preferred embodiment, sighting member 160 is in the form of crossplates 162 and 164. Plate 162 extends generally perpendicularly between top 154 and bottom 156 and is located generally midway between, parallel to and spaced from sides 158 of parallelepiped 152. Plate 162 has a parallelogram shape and size identical to sides 158 of parallelepiped 159. Plate 164 intersects and is integral with plate 162 and extends generally perpendicularly between sides 158 and located generally parallel to and spaced from top 154 and bottom 156. Plate 164 has a rectangular shape and size identical to top 154 and bottom 156. To allow slidable receipt of sight portion 138 on end 150 of tubular portion 136, longitudinal slots 166 are formed in top 142 and bottom 144 of tubular portion 136 for slidably receiving plate 162 and longitudinal slots 168 are formed in sides 144 of tubular portion 136 for slidably receiving plate 164.

To further enhance the fast and accurate sighting and aiming of rifle 12, slots may be formed in range finder card 30 extending from top 66, bottom 54 and sides 56 of opening 20 corresponding to the location of plates 162 and 164 for quickly directing the viewer's line of sight towards plates 162 and 164. Thus, rear opening 20 of viewing apparatus 10 according to FIG. 7 of the teachings of the present invention acts in effect as a rear sight for sight member 160 which then in effect acts as a front sight.

In its most preferred form, elevation and windage adjustment portion 134 includes an upstanding, cylindrical post 180 extending from central portion 36 intermediate apertures 40 and 42. Portion 134 further includes a first turntable plate 182 having a central, circular aperture 184 for slidable receipt on post 180, first and second upstanding lugs 186 spaced from and on opposite sides of aperture 184, and members 188 for preventing rotation of plate 182 about post 180 shown in its most preferred form as ends extending downwardly from plate 182 which abut with the ends of central portion 36. Portion 134 further includes a member 190 for receipt of tubular portion 136 in an adjustable vertical position. In its most preferred form, member 190 is generally U-shaped and includes first and second legs 192 extending from opposite sides of a central portion 194. Legs 192 in their most preferred form are parallelogram-shaped and have the same angular configuration as sides 158 of sight portion 138. First and second elongated slots 196 and 198 are formed in legs 192 generally spaced from and parallel to the side edges thereof, with slot 196 terminating in the free ends of legs 192 and with slot 198 terminating at a point spaced from the free ends of legs 192. Elongated protuberances 200 are formed on sides 146 of tubular portion 136 generally parallel to and spaced from end 150 for reciprocal receipt in slots 196. In the most preferred form, protuberances 200 have a height beyond sides 146 generally equal to the thickness of legs 192 and further include ears 202 formed on their upper ends providing an abutment for the viewer's thumb during adjustment. For fixing tubular portion 136 in member 190 at the desired vertical position, screws 204 may be provided extending through slots 198 and for threadable receipt in sides 146 of tubular portion 136. In the preferred form, a generally oval shaped extension 205 may be provided around slot 198 extending beyond the head of screws 204 to recess it therein to prevent screws 204 from catching on other objects and to provide a unique ornamental appearance.

Second turntable plate 206 is provided in the preferred form on the bottom of central portion 194 and includes a central, circular aperture 208 for slidable receipt on post 180 and first and second arcuate slots 210 spaced from, on opposite sides of, and concentric to aperture 208 and having a size and shape for receipt on lugs 186 of turntable plate 182. For securing central portion 36, plate 182 and member 190 together, screw 212 is provided in the preferred form extending through central portion 194 and threadably received in post 180. A set screw 213 may be threadably provided in turntable plate 206 to abut with post 180 received in aperture 208 for assisting screw 212 in holding member 190 at the desired angle with respect to central portion 36 and thus rifle 12.

Cover 140 in its most preferred form is vinyl-covered metal having a size and shape complementary to and for receipt on tubular portion 136 intermediate end 148 and sight portion 138. Cover 140 includes slots 214 in its downwardly extending walls for receipt around legs 192 of elevation and windage adjustment portion 134. To secure cover 140 to tubular portion 136, cover 140 includes snap edges 76 for removable abutment with bottom 144 of tubular portion 136. In its most preferred form, the vinyl of cover 140 includes a camouflage pattern.

To install and sight in viewing apparatus 10 according to the preferred form as shown in FIGS. 7 and 8, and assuming that sight portion 138 is secured to tubular portion 136, central portion 36 may be secured to rifle 12 by screws 44 extending through apertures 40 and 42 and threadably received in the scope mount sets of rifle 12, and in the preferred form, the front pair of scope mount sets of rifle 12. At that time, turntable plate 182 and member 190 may be slidably received on post 180 and secured thereto such as by screw 212. Tubular portion 136 may then be slidably received in member 190. At that time, windage adjustments may be made by test firing rifle 12 and pivoting member 190 about post 180 when screw 212 is in a loosened condition between test shots to vary the angular mounting of tubular portion 136 with respect to rifle 12. When the windage adjustment is at the desired angle, screw 212 may be securely tightened in post 180 and set screw 213 tightened to abut with post 180 to fix tubular portion 136 at the desired angle with respect to rifle 12.

At that time, elevation adjustment may be made by test firing rifle 12 and sliding tubular portion 136 in member 190 to the desired elevation between test shots. In the most preferred form with screws 204 in a loosened condition, the user's thumb may push against ears 202 of protuberances 200 for moving tubular portion 136 in member 190. It should further be noted that in addition to the unique ornamental appearance created by the angularity of member 190, protuberances 200, sight portion 136, and end 150, the angularity of slots 196 of member 190 and protuberances 200 requires the movement direction to be an angle and thus requiring further movement than if a pure vertical slide was provided. Additionally, tubular portion 136 and rear opening 20 also moves further away from the user's eye as tubular portion 136 is elevated in member 190 which increases sighting accuracy. When the elevation adjustment is at the desired position, screws 204 may be tightened to sandwich legs 192 against sides 146 of tubular portion 136 to fix tubular portion 136 in member 190.

It should then be noted that viewing apparatus 10 utilizing sight portion 138 is particularly advantageous in addition to the advantages gained by passage 18. Specifically, it can be appreciated that rifle 12 is correctly oriented and sighted with the targeted object, sight member 160 would appear as a single cross hair to the viewer's view. However, if rifle 12 is not correctly oriented and sighted with the targeted object, at least one face of plates 162 and 164 would be seen by the viewer due to the planar nature of plates 162 and 164 rather than only linear nature as in scope sights. Thus, fast and accurate sighting and aiming of rifle 12 is possible utilizing sight portion 138 according to the teachings of the present invention.

Now that the basic construction and operation of viewing apparatus 10 according to the preferred embodiments of the teachings of the present invention have been explained, subtle features and advantages of the present invention can be set forth and appreciated. Due to the removable securement of covers 32 and 140 to viewing apparatus 10 according to the teachings of the present invention, covers 32 and 140 may be instantly replaced to include vinyl coverings to match the hunting cover and particular season.

In the most preferred form, viewing apparatus 10 according to the teachings of the present invention aside from front and rear sights 14 and 16, covers 32 and 140, and the screws are formed of castable, plastic-type material such as glass filled polypropylene. Viewing apparatus 10 are very durable, relatively unbreakable, economical to manufacture and assemble, and are lightweight according to the teachings of the present invention.

In the preferred embodiment of viewing apparatus 10 according to the teachings of the present invention shown in FIG. 6, mounting shoulders 50 are in a staggered condition to keep top portion 28 from bowing when assembled with base portion 26. In its most preferred form, shoulders 50 are located adjacent the front and rear ends of one of the side edges of base plate 84 and are located spaced from the front and rear ends of the other of the side edges of base plate 84.

Further, it can be appreciated that screws 72 of viewing apparatus 10 according to the teachings of the present invention may be utilized for mounting further accessories to viewing apparatus 10, if desired.

It can then be appreciated that viewing apparatus 10 according to the teachings of the present invention provides an affordable and viable alternative to the sportsman over precision scope purchases and the sportsman has a better alternative to open sight usage. Viewing apparatus 10 according to the teachings of the present invention are high quality essential aids for a one shot kill which eliminate the pain and suffering of wounded game animals and careless misuse of weapons and which greatly enhance the sport of hunting by increasing the odds of a higher kill ratio and by reducing wounded game. The sportsman utilizing weaponry equipped with viewing apparatus 10 according to the teachings of the present invention can feel the fulfillment of a successful hunt, making the adventure a worthwhile experience both financially and for peace of mind.

For example, heavy brush and forest, all low light areas, cause a hunter to either over concentrate when aiming or lose concentration totally due to obstructed views while trying to sight-in on moving targets or obscure target areas. Separating the targeted object from its surroundings is one of the most important, if not the most important means of achieving a one shot kill and a one shot kill is an achievement which should be the goal of all serious hunters and the biggest thrill of a stalk and still hunter. It can then be appreciated that viewing apparatus 10 according to the teachings of the present invention is an effective aid in zeroing in on the targeted object and is a means of achieving total focal concentration on the targeted object. Specifically, passage 18, rear and front openings 20 and 22, and perimeter portion 21 play a trick on the viewer's vision which is capitalized on in making the targeted object become clearer and almost seem magnified due to this total focal concentration created by the separation of the targeted object from its surroundings.

Therefore, viewing apparatus 10 according to the teachings of the present invention obtains the advantages of the accuracy of scope sights and the speed of open sights without their drawbacks including the lens orientation required in scope sights and the fogging and moisture beading problems on lenses of scope-type sights.

Now that the basic teachings of the present invention have been explained, many extensions and variations will be obvious to one having ordinary skill in the art. For example, although viewing apparatus 10 are shown and described in the preferred form utilized with rifle 12, it will be immediately apparent to one skilled in the art that viewing apparatus 10 according to the teachings of the present invention may be utilized with other types of firearm weaponry such as shotguns, pistols, with other types of weaponry such as bows, or with other types of apparatus requiring fast, precise, and effective sighting and/or aiming.

It should be noted that viewing apparatus 10 may be equipped with other devices for enhancing viewing, aiming, and sighting, if desired. For example, a battery operated light may be provided within passage 18 and front and rear sights 14 and 16 and sight portion 138 may be coated with florescent material to aid in utilizing viewing apparatus 10 in low light environments according to the teachings of the present invention.

Although preferred constructions of viewing apparatus 10 including a hooded, enclosed and elongated see-through passage 18 have been set forth, it can be appreciated that viewing apparatus 10 can be of other types and constructions according to the teachings of the present invention. Likewise, although sighting devices have been shown in their most preferred forms as front and rear sights 14 and 16 and sight portion 138, other types and constructions of sighting apparatus or devices may be utilized according to the teachings of the present invention. Similarly, although viewing apparatus 10 according to the teachings of the present invention is shown as what is believed to be particularly advantageous constructions for providing elevation and windage adjustments, other types and forms of elevation and windage adjustments may be utilized with viewing apparatus 10 according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for providing elevation adjustment of a sighting apparatus with respect to weaponry comprising, in combination: means for adjustably securing the sighting apparatus to the weaponry at one of a plurality of positions with respect to the weaponry between an upper position and a lower position, with the sighting apparatus being parallel in each of the plurality of positions to the upper and lower positions; with the adjustably securing means comprising, in combination: a generally U-shaped member for slidably receiving the sighting apparatus, with the U-shaped slidably receiving member including first and second legs extending on opposite sides of a central portion, with the central portion secured to the weaponry, with the first and second legs having a thickness; elongated protuberances formed on opposite sides of the sighting apparatus and having a height beyond the sides of the sighting apparatus generally equal to the thickness of the legs; elongated slots formed in the first and second legs of the slidably receiving U-shaped member for receiving the elongated protuberances, with the protuberances being accessible through the elongated slots; and means for removably fixing the sighting apparatus in the slidably receiving member.

2. The device of claim 1 further comprising, in combination: means for providing windage adjustment of the sighting apparatus comprising means for adjustably securing the sighting apparatus to the weaponry at one of a plurality of angles about an axis generally perpendicular to the viewer's sighting direction along the sighting apparatus; with the windage adjustment means comprising, in combination: a cylindrical post secured on one of the weaponry and the sighting apparatus; a turntable plate formed on the other of the weaponry and the sighting apparatus, with the turntable plate including a circular aperture for slidable receipt on the cylindrical post; and means for removably holding the turntable plate on the cylindrical post at the desired angle.

3. The device of claim 2 wherein the windage adjustment means further comprises, in combination: at least a first lug spaced from the cylindrical post and the circular aperture and upstanding from one of the weaponry and the sighting apparatus; and an arcuate slot formed in the other of the weaponry and the sighting apparatus concentric with the cylindrical post and the circular aperture and for receiving the lug.

4. The device of claim 3 wherein the windage adjustment means further comprises, in combination: a central portion, with the central portion including means for mounting to the weaponry, with the cylindrical post formed on and extending from the central portion; a second turntable plate including an aperture for receipt on the post; and means for preventing rotation of the second turntable plate about the cylindrical post and relative to the central portion.

5. The device of claim 4 wherein the rotation preventing means comprises ends extending downwardly from the second turntable plate and abutting with the ends of the central portion.

6. The device of claim 5 wherein the removably holding means comprises a screw extending through the first turntable plate and threadably received in the cylindrical post.

7. The device of claim 2 wherein the removably holding means comprises a screw extending through the turntable plate and threadably received in the cylindrical post.

8. The device of claim 1 wherein the removably fixing means comprises, in combination: a second elongated slot formed in the first arm generally parallel to and spaced from the first elongated slot formed in the first arm; and a screw extending through and for threadable receipt in the sighting apparatus, with the screw being slideably received in the second elongated slot.

9. The device of claim 8 further comprising, in combination: a generally oval shaped extension provided around the second elongated slot and extending beyond the screw to recess the screw therein.

10. The device of claim 9 wherein the first elongated slots terminate in the free ends of the first and second legs; and wherein the second elongated slot terminates at a point spaced from the free ends of the first leg.

11. The device of claim 8 wherein the first elongated slots terminate in the free ends of the first and second legs; and wherein the second elongated slot terminates at a point spaced from the free ends of the first leg.

12. Turntable for providing adjustment of a sighting apparatus with respect to weaponry comprising, in combination: a first turntable plate; a second turntable plate for mounting to the sighting apparatus; a post upstanding from the first turntable plate; an aperture formed in the second turntable plate for receiving the post; means for securing the first turntable plate to the second turntable plate; at least a first lug spaced from the post and the aperture and upstanding from one of the first and second turntable plates; an arcuate slot formed on the other of the first and second turntable plates concentric with the post and the aperture and for receiving the lug; a central portion, with the central portion including means for mounting to the weaponry, with the post formed on and extending from the central portion, with the first turntable plate including an aperture for receipt on the post; and means for preventing rotation of the first turntable plate about the post and relative to the central portion; wherein the rotation preventing means comprises ends extending downwardly from the first turntable plate and abutting with the ends of the central portion; wherein the securing means comprises a screw extending through the second turntable plate and threadably received in the post of the first turntable plate.

* * * * *